US006092271A

United States Patent [19]

Stojkovic et al.

[11] Patent Number: 6,092,271

[45] Date of Patent: Jul. 25, 2000

[54] METHOD AND TOOL FOR ALIGNING A STRIKER WITH A LATCH

[75] Inventors: Zlatko B. Stojkovic, Brownstown; Thomas Weber, Birmingham; Don Johnson, Monroe; John D. Dredge, Livonia; Larry M. Storinsky, Rochester Hills; Jim Neubacher, Howell, all of Mich.; Scott Featherston, Bear, Del.; Brad DiTomaso, Windsor, Canada

[73] Assignee: Chrysler Corporation, Auburn Hills, Mich.

[21] Appl. No.: 08/924,363

[22] Filed: Sep. 5, 1997

[51] Int. Cl.[7] ..... B25B 11/00

[52] U.S. Cl. ..... 29/281.5; 29/271; 29/281.1; 269/8; 269/904

[58] Field of Search ..... 29/464, 468, 281.4, 29/281.5, 281.1, 271; 269/8, 904

[56] References Cited

U.S. PATENT DOCUMENTS

| | | | |
|---|---|---|---|
| 5,282,305 | 2/1994 | Nutt et al. | 29/464 X |
| 5,653,012 | 8/1997 | Pasternak et al. | 29/281.4 |
| 5,694,675 | 12/1997 | Pasternak et al. | 29/468 |

*Primary Examiner*—Joseph M. Gorski
*Attorney, Agent, or Firm*—James R. Yee

[57] ABSTRACT

A tool for aligning a striker with a latch for a door on a motor vehicle includes a base member and a tool locating member positioned perpendicular to an end of the base member. The tool also includes a tool holding mechanism positioned on a front face of the tool locating member for holding the alignment tool onto the vehicle, and a striker locating arm extending outwardly from another end of the base member. The alignment tool further includes a striker lead-in at one end of the striker locating arm for positioning the striker relative to the latch, and a cross member extending between another end of the striker locating arm and the base member for receiving the latch.

11 Claims, 4 Drawing Sheets

METHOD AND TOOL FOR ALIGNING A STRIKER WITH A LATCH

BACKGROUND OF THE INVENTION

1. Field of the Invention

The present invention relates generally to doors for motor vehicles and, more particularly, to a method and tool for aligning a striker with a latch for a door on a motor vehicle.

2. Description of the Related Art

A motor vehicle may include a closure panel such as a door, a hood, or a liftgate. Typically, the closure panel includes a latch that engages a striker positioned on a vehicle body of the motor vehicle. For example, to retain the door in a closed position, the door includes a latch that engages the striker, which is mounted on a door frame of the vehicle body. A liftgate on a truck includes a latch that similarly engages a striker mounted on a liftgate frame of the vehicle body for holding the liftgate in a closed position. A hood also includes a latch for engaging with a striker positioned on the vehicle body of the motor vehicle to retain the hood in a closed position.

Motor vehicle manufacturers, in response to market competitiveness, are continuously improving their vehicles in areas such as vehicle fit and finish, and quietness. For example, the fit of a door to a body panel, the effort to close the door, or the quietness of the door can all be enhanced by proper alignment of the door latch and striker. The door latch and striker alignment may be determined during the vehicle assembly process. In one example of a vehicle assembly process, the vehicle is painted in a step. In another step, the vehicle door is removed to protect the paint finish of the door while the vehicle is being assembled. In still another step, after the vehicle is nearly complete, the door is reinstalled on the vehicle. In a further step, an assembler, using a trial and error process, initially positions the striker, so that the striker is engaged by the door latch when the door is closed. The assembler tightens a retaining fastener for the striker, and shuts the door. If the door is difficult to close, or the door is not flush with the vehicle body panel, the assembler continues to adjust the position of the striker and test the door, until the striker alignment is improved.

Since the dimensional relationship between the striker and latch should be strictly maintained to minimize door closing efforts and door-related noises, the trial and error methodology is time-consuming and inaccurate. Thus, there is a need in the art for improving alignment of a door striker with a latch.

SUMMARY OF THE INVENTION

It is, therefore, one object of the present invention to provide a method for aligning a striker with a latch on a motor vehicle.

It is another object of the present invention to provide a tool for aligning a door striker with a latch on a motor vehicle.

It is yet another object of the present invention to provide a tool that positively aligns a door striker with a door latch on a motor vehicle.

It is still another object of the present invention to provide a method for using the tool to align a door striker with the door latch on a motor vehicle.

To achieve the foregoing objects, the present invention is a method and tool for aligning a striker with a latch for a door on a motor vehicle. The tool includes a base member and a tool locating member positioned perpendicular to an end of the base member. The tool also includes a tool holding mechanism positioned on a front face of the tool locating member for holding the tool onto the motor vehicle, and a striker locating arm extending outwardly from another end of the base member. The tool further includes a striker lead-in at one end of the striker locating arm for positioning the striker relative to the latch, and a cross member extending between another end of the striker locating arm and the base member for receiving the latch.

One advantage of the present invention is that a new method and tool for aligning a striker with a latch for a door on a motor vehicle is provided. Another advantage of the present invention is that the tool accurately positions a door striker relative to the latch, independent of the relative orientation of the door. Yet another advantage of the present invention is that the improved fit of the door to the vehicle body minimizes door closing effort and rattling of the latch and striker. Still another advantage of the present invention is that a method for using the tool is provided that initially positions the striker to avoid a trial and error procedure.

Other objects, features and advantages of the present invention will be readily appreciated as the same becomes better understood after reading the subsequent description taken in connection with the accompanying drawings.

DESCRIPTION OF THE PREFERRED EMBODIMENT(S)

Figure 1:
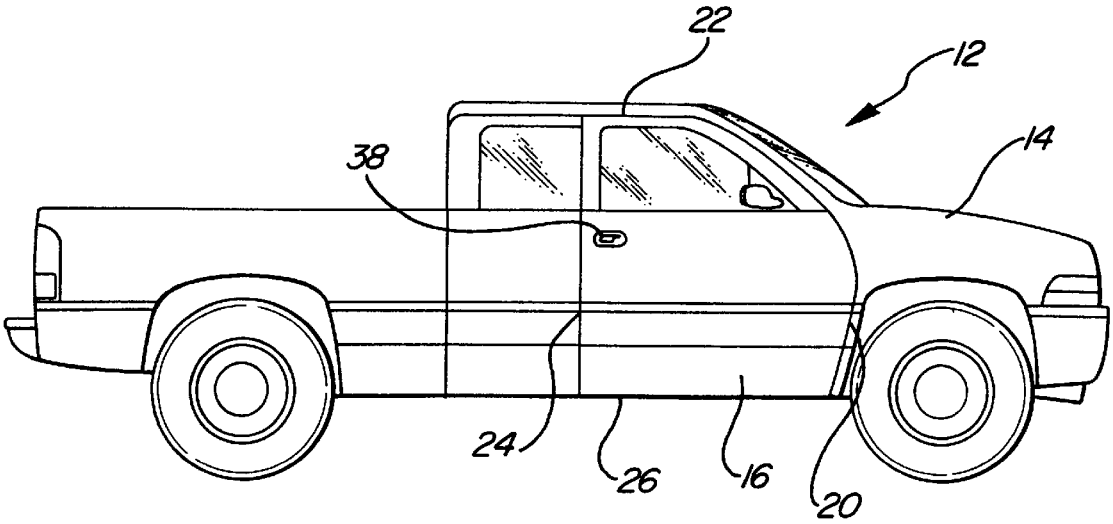
FIG. 1 is an elevational view of a motor vehicle.

Referring to FIG. 1, one embodiment of a motor vehicle 12, such as a truck in this example, is illustrated. The motor vehicle 12 includes a vehicle body 14 formed from a plurality of panels which generally define the structural shape of the vehicle 12. The vehicle body 14 includes at least one closure panel portion, such as a door 16, a hood (not shown), or a liftgate (not shown).

The door 16 encloses a door opening 18 (FIG.5A), as is well known in the art. The door opening 18 is generally defined by a first side 20, a top side 22, a second side 24 and a bottom side 26. The first side 20 extends vertically. The top side 22 is adjacent to the first side 20. The second side 24, is adjacent to the top side 22 and opposite the first side 20. The bottom side 26 is between the first side 20 and the second side 24, and opposite the top side 22. The door 28 is pivotedly mounted to the first side 20 by suitable means such as hinges (not shown) as known in the art. The door 16, in a closed position, is retained to the second side 24, in a manner to be described, such that in a closed position the door 16 and vehicle body 14 form a relatively generally planer surface.

Figure 2:
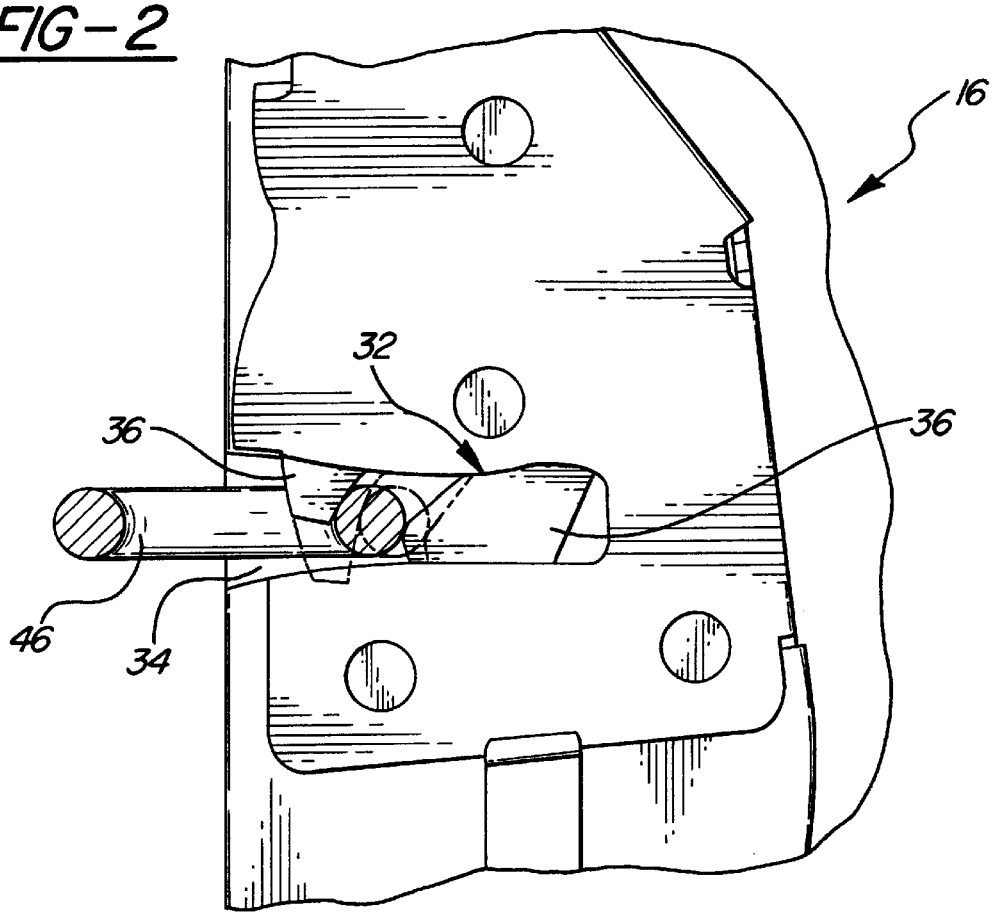
FIG. 2 is a fragmentary plan view of a door striker and latch for the motor vehicle of FIG. 1.
Figure 3:
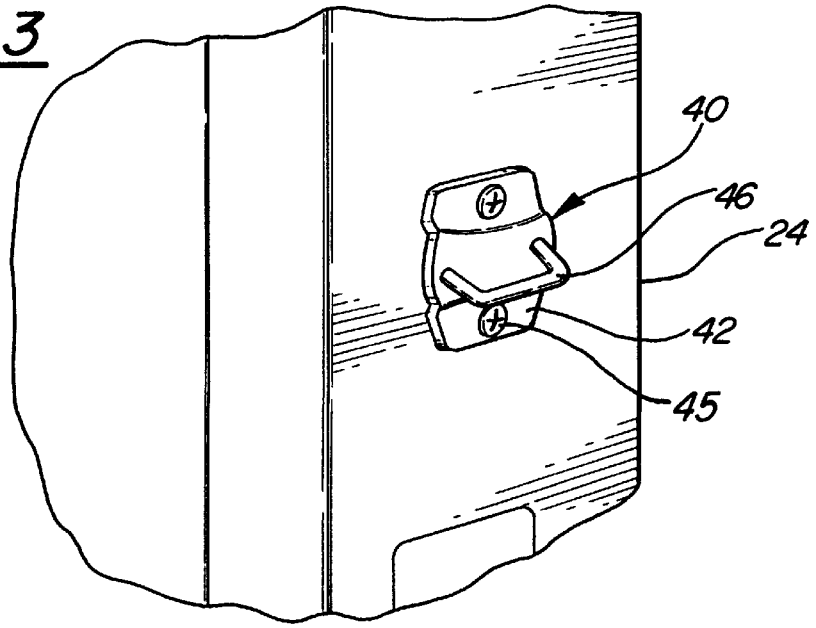
FIG. 3 is a perspective view of the door striker for the motor vehicle of FIG. 1.

Referring to FIGS. 2 and 3, the door 16 includes a latch 32 for maintaining the door 16 in a closed position. The latch 32, as is well known in the art, includes a striker retaining portion 34, defining a generally U-shaped opening. The latch 32 also includes a hooking mechanism 36 within the striker retaining portion 34. The hooking mechanism 36 is operably connected to a door handle 38 positioned on the door 16, as illustrated in FIG. 1.

The vehicle body 14 includes a striker 40 mounted to the second side 24. The striker 40 includes a plate 42 portion having an attachment opening 44 therein for attaching the plate 42 to the second side 24. Preferably, there are two attachment openings 44 and the plate 42 is secured to the second side 24 using a fastener such as a screw 45. The striker 40 includes a C-shaped member 46 outwardly extending perpendicular to the plate 42. Preferably, the C-shaped member 46 is circular in cross-sectional shape.

To close the door 16, the door 16 is directed in a closing direction, until the striker's C-shaped member 46 is fixedly engaged within the striker retaining portion 34 by the hooking mechanism 36, as illustrated by the dotted lines of FIG. 2. To open the door 16, the door handle 38 is moved to disengage the hooking mechanism 36 from the striker's C-shaped member 46, so that the door 16 can pivot in an open direction.

The alignment of the striker retaining portion 34 and the striker 40 influence the operation of the door 16. For example, a noise commonly referred to in the art as "door chucking", occurs as a result of the rattling of the striker's C-shaped member 46 within the striker retaining portion 34. One method for reducing "door chucking" is to decrease the size of the striker retaining portion 34. However, a decreased size of the striker retaining portion 34 requires that the spatial relationship between the striker retaining portion 34 and the striker 40 be tightly controlled, such as to ±0.25 mm. A variation in the installed position of the door 16, such as ±2.5 mm, may alter the alignment between the striker retaining portion 34 and the striker 40. An example of an effect of misalignment between the striker 40 and the striker retaining portion 34 is an increased door 16 closure effort, or a "popping" noise when opening the door 16.

Figure 4:
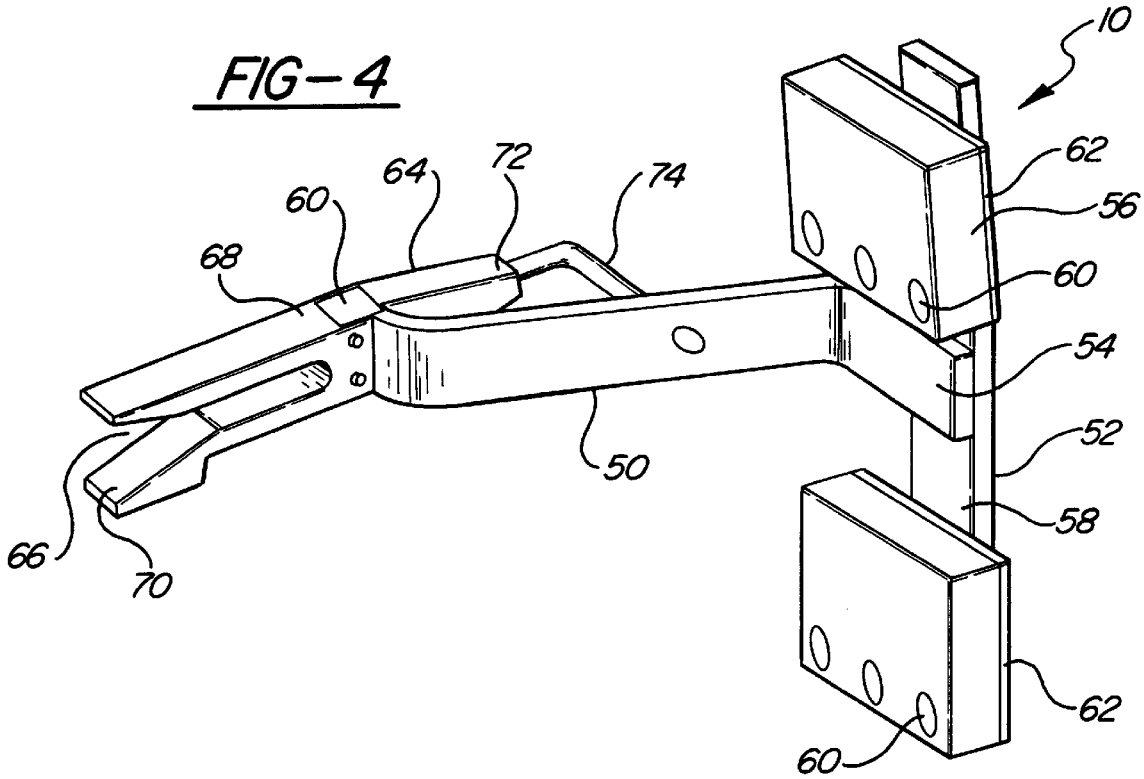
FIG. 4 is a perspective view of a tool according to the present invention, for aligning the door striker and door latch of FIGS. 2 and 3.

Referring to FIG. 4, a tool 10, according to the present invention, for aligning the striker 40 with the latch 32 is illustrated. The tool 10 improves the alignment between the striker 40 and latch 32, by initially positioning the striker 40 relative to the striker receiving portion 34 of the latch 32 so that the door 16 is flush to the vehicle body 14 in a cross-car position. It should be appreciated that for purposes of dimensional reference, the length of the motor vehicle 12 is referred to as the fore-aft position, the width of the motor vehicle 12 is the cross-car position, and the height of the motor vehicle 12 is the up-down position.

The tool 10 includes a base member 50 having a generally rectangular shape. The tool 10 also includes a tool locating member 52 having a generally rectangular shape. The tool locating member 52 is positioned at an end 54 of the base member 50, extending substantially perpendicular to the base member 50.

The tool 10 includes a tool holding mechanism 56 on a front face of the tool locating member 58, for holding the tool 10 onto the vehicle body 14. Preferably, the tool holding mechanism 56 is a block consisting of a non-abrasive material, such as Delrin plastic. Embedded within the block 56 is a holding mechanism, such as a magnet 60. The magnet 60 retains the tool 10 onto the vehicle body 14. It should be appreciated that, in this example, there are two tool holding mechanisms 56 positioned at each end of the front face 58.

The tool locating member 52 also includes a shim 62 positioned between the tool holding mechanism 56 and the front face of the tool locating member 58. The shim 62 varies the height of the tool holding mechanism 56, such as to set the cross-car position of the door 16.

The tool 10 also includes a striker locating arm 64 extending outwardly from an other end of the base member 50 in a normal direction. One end of the striker locating arm 64 includes a striker lead-in portion 68 having a U-shaped 66 opening for fitting around the striker 40. It should be appreciated that, in this embodiment, an upper end 70 of the striker lead-in portion 68 ramps in an outwardly direction to facilitate receiving the striker 40 into the striker lead-in portion 68. The striker lead-in portion 68 positions the striker 40 in an up-down position relative to the door latch 32. The striker lead-in portion 68 also includes a holding mechanism, such as a magnet 60, imbedded therein. Preferably, the magnet 60 is located near a lower portion of the U-shaped opening 68, to fixedly hold the striker lead-in portion 68 to the striker 40.

The striker locating arm 64 includes a cross member 74 positioned between an other end of the striker locating arm 72 and the base member 50. Preferably, the cross member 74 is cylindrically shaped and has the same dimensional characteristics as the striker 40. The cross member 74 simulates the striker 40 in aligning the striker 40 within the striker retaining portion 34.

Figure 5A:
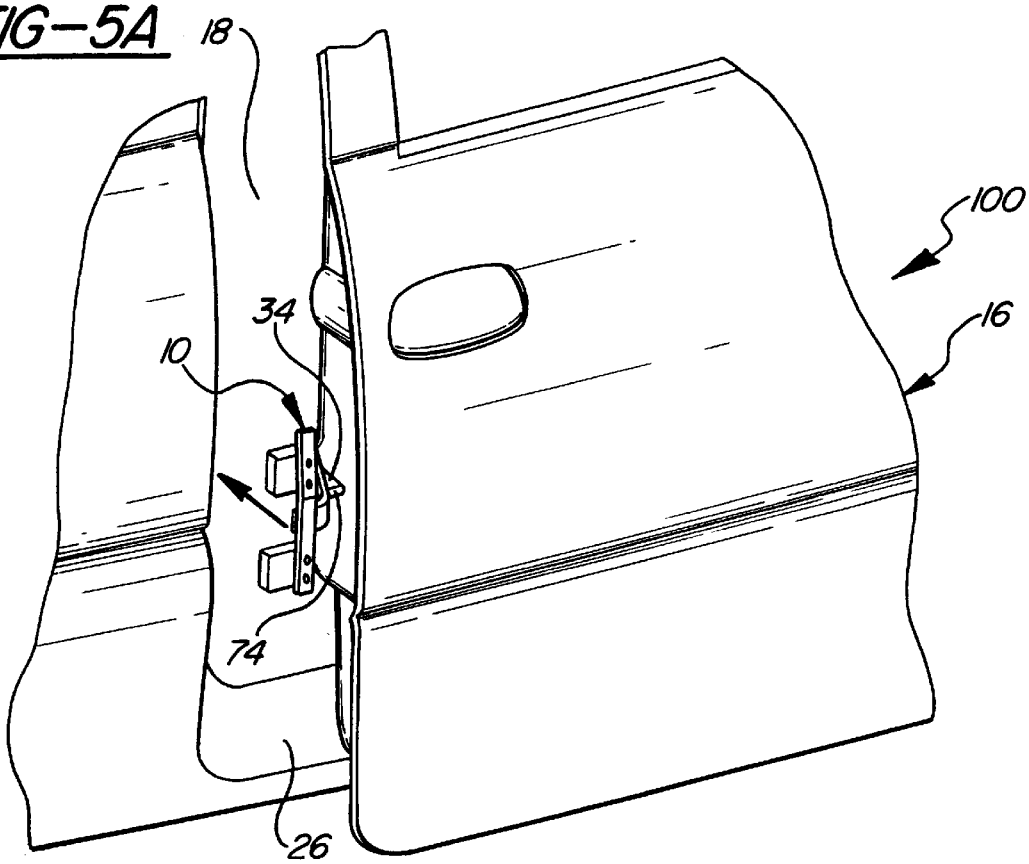
FIGS. 5A, 5B, and 5C illustrate steps of a method, according to the present invention, for aligning the door striker and the door latch of FIGS. 2 and 3 using the alignment tool of FIG. 4.
Figure 5B:
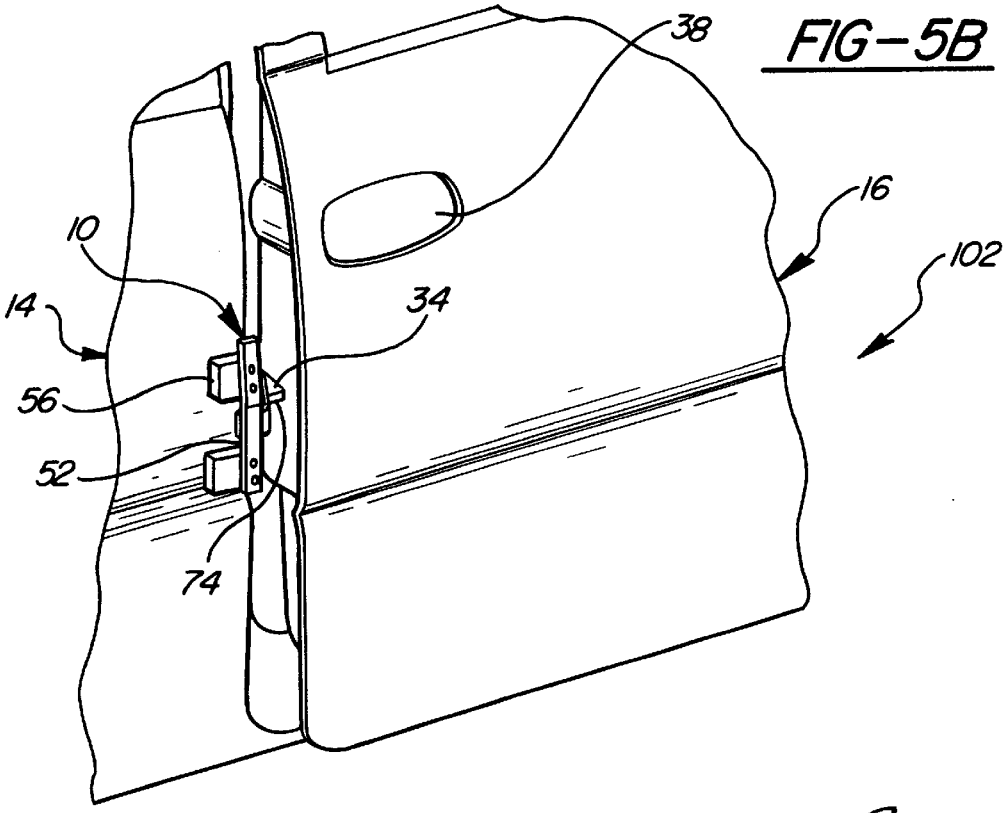
Figure 5C:
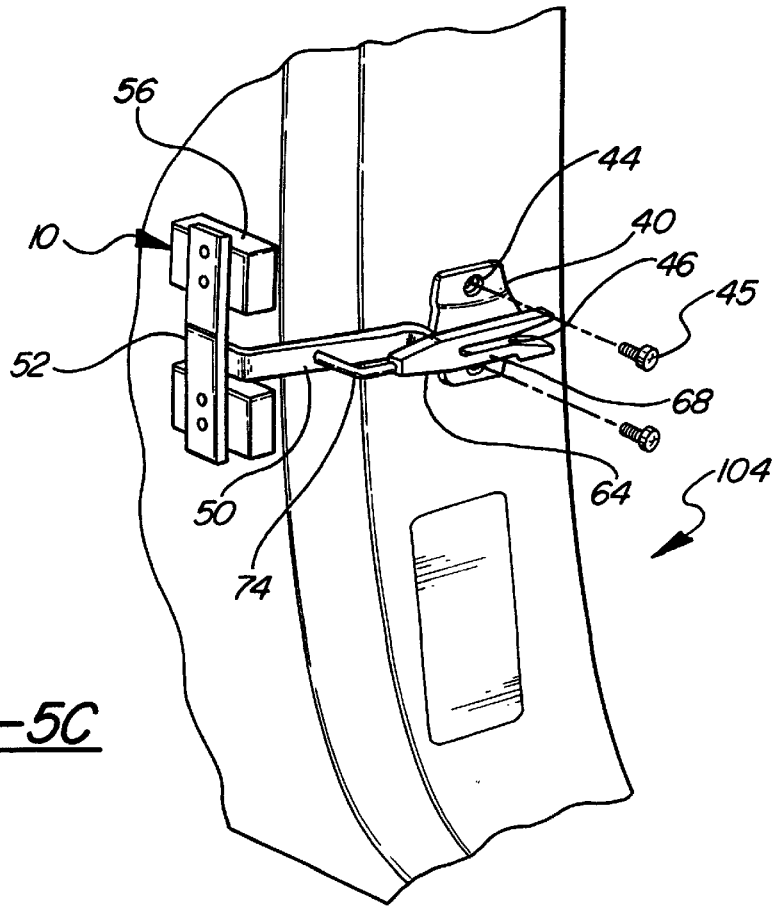

Referring to FIGS. 5A, 5B, and 5C, a method for aligning the striker 40 using the tool 10 of FIG. 4 is described. In a first Step 100, as shown in FIG. 5A, the door 16 is in an open position. The cross member 74 of the tool 10 is placed within the striker retaining portion 34 of the latch 32 until it is engaged by the hooking mechanism 32.

In a second Step 102, as shown in FIG. 5B, the operator (not shown) partially closes the door 16 until the tool holding mechanism 56 is retained against the vehicle body 14. In this example, the magnet 60 holds the tool 10 to the vehicle body 14. Concurrent with closing the door 16, the striker lead-in 68 is positioned about the striker 40. Preferably, the striker 40 is loosely held by a fastening mechanism, such as a screw 45. The magnet 60 fixedly holds the striker lead-in 68 to the striker 40. It should be appreciated that the dimensional relationship between the cross member 74, striker lead-in 68, and tool holding mechanism 56, is determined such that the door 16 would be flush in a cross-car direction with the vehicle body 14, and the striker 40 would be properly aligned in the latch 32 in an up and down direction, if the door 16 was in a closed position.

In a third Step 104, as shown in FIG. 5C, the operator moves the door handle 38 to release the hooking mechanism 36, and opens the door 16. It should be appreciated that, in this example, the magnet 60 fixedly retains the tool 10 to the vehicle body 14. The operator then torques down the screw 45 to secure the striker 40 in the preferred alignment. The operator then removes the tool 10 from the vehicle 12.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A tool for aligning a striker with a latch for a door on a motor vehicle comprising:

a base member having a first end, a second end, a first surface and an opposite facing second surface;

a tool locating member having a front surface, and being connected to said base member at said first end such that the front surface is laterally offset from said first end in a first lateral direction;

a tool holding mechanism connected to said front surface for holding said tool onto the motor vehicle;

a shim positioned between said tool holding mechanism and said front surface for setting a cross-car position of the door;

a striker locating arm having a front end, a back end, and a rear surface at the back end facing in a direction generally towards said front surface, wherein the striker locating arm is connected to said base member at said second end such that the striker locating arm extends from said second end in a direction generally away from said front surface and is laterally offset from said second surface in a second lateral direction that is generally opposite said first lateral direction;

a striker lead-in for positioning the striker relative to the latch, wherein the striker lead-in is connected to said striker locating arm at said front end and extends from said front end in said direction generally away from said front surface; and a cross member connected to said base member and said striker locating arm at said back end such that the cross member extends from said second surface generally in said second lateral direction and is located between said front surface and said back end.

2. The tool as set forth in claim 1 wherein said tool holding mechanism includes a magnet for holding said tool on the motor vehicle.

3. A tool for aligning a striker with a latch for a closure panel on a motor vehicle comprising:

a base member having a first end, a second end, a first surface and an opposite facing second surface;

a tool locating member having a front surface, and being connected to said base member at said first end such that the front surface is laterally offset from said first end in a first lateral direction;

a block of a non-abrasive material having a magnet embedded therein positioned at each end of said front surface, for holding said tool onto the motor vehicle;

a striker locating arm having a front end, a back end, and a rear surface at the back end facing in a direction generally towards said front surface, wherein the striker locating arm is connected to said base member at said second end such that the striker locating arm extends from said second end in a direction generally away from said front surface and is laterally offset from said second surface in a second lateral direction that is generally opposite said first lateral direction;

a striker lead-in having a U-shaped opening for positioning the striker relative to the latch, wherein the striker lead-in is connected to said striker locating arm at said front end and extends from said front end in said direction generally away from said front surface; and a cross member connected to said base member and said striker locating arm at said back end such that the cross member extends from said second surface generally in said second lateral direction and is located between said front surface and said back end.

4. The tool as set forth in claim 3 wherein an upper end of said U-shaped opening ramps outboard.

5. A tool for aligning a striker with a latch for a door on a motor vehicle comprising:

a base member having a first end, a second end, a first surface and an opposite facing second surface;

a tool locating member having a front surface, and being connected to said base member at said first end such that the front surface is laterally offset from said first end in a first lateral direction;

a block of a non-abrasive material having a magnet embedded therein at each end of said front surface for holding said tool onto the motor vehicle;

a striker locating arm having a front end, a back end, and a rear surface at the back end facing in a direction generally towards said front surface, wherein the striker locating arm is connected to said base member at said second end such that the striker locating arm extends from said second end in a direction generally away from said front surface and is laterally offset from said second surface in a second lateral direction that is generally opposite said first lateral direction;

a striker lead-in for positioning the striker relative to the latch, wherein the striker lead-in is connected to said striker locating arm at said front end and extends from said front end in said direction generally away from said front surface; and a cross member connected to said base member and said striker locating arm at said back end such that the cross member extends from said second surface generally in said second lateral direction and is located between said front surface and said back end.

6. The tool as set forth in claim 5 including a shim positioned between said tool holding mechanism and said front surface.

7. The tool as set forth in claim 6 wherein said shim varies a height of said tool holding mechanism to set a cross-car position of the door.

8. A tool for aligning a striker with a latch for a door on a motor vehicle comprising:

a base member having a first end, a second end, a first surface and an opposite facing second surface;

a tool locating member having a front surface, and being connected to said base member at said first end such that the front surface is laterally offset from said first end in a first lateral direction;

a tool holding mechanism connected to said front surface for holding said tool onto the motor vehicle;

a striker locating arm having a front end, a back end, and a rear surface at the back end facing in a direction generally towards said front surface, wherein the striker locating arm is connected to said base member at said second end such that the striker locating arm extends from said second end in a direction generally away from said front surface and is laterally offset from said second surface in a second lateral direction that is generally opposite said first lateral direction;

a striker lead-in for positioning the striker relative to the latch, wherein the striker lead-in is connected to said striker locating arm at said front end and extends from said front end in said direction generally away from said front surface, said striker lead-in including a U-shaped opening including a magnet embedded near a lower portion of said U-shaped opening for fixedly holding said striker lead-in to the striker; and a cross member connected to said base member and said striker locating arm at said back end such that the cross member extends from said second surface generally in said second lateral direction and is located between said front surface and said back end.

9. The tool as set forth in claim 8 wherein an upper end of said U-shaped opening ramps outboard.

10. A tool for aligning a striker with a latch for a closure panel on a motor vehicle comprising:

a base member having a first end, a second end, a first surface and an opposite facing second surface;

a tool locating member having a front surface, and being connected to said base member at said first end such that the front surface is laterally offset from said first end in a first lateral direction;

a tool holding mechanism connected to each end of said front surface for holding said tool onto the motor vehicle;

a shim positioned between said tool holding mechanism and said front surface to vary a height of said tool holding mechanism to set a cross-car position of the closure panel;

a striker locating arm having a front end, a back end, and a rear surface at the back end facing in a direction generally towards said front surface, wherein the striker locating arm is connected to said base member at said second end such that the striker locating arm extends from said second end in a direction generally away from said front surface and is laterally offset from said second surface in a second lateral direction that is generally opposite said first lateral direction;

a striker lead-in having a U-shaped opening for positioning the striker relative to the latch, wherein the striker lead-in is connected to said striker locating arm at said front end and extends from said front end in said direction generally away from said front surface; and a cross member connected to said base member and said striker locating arm at said back end such that the cross member extends from said second surface generally in said second lateral direction and is located between said front surface and said back end.

11. A tool for aligning a striker with a latch for a closure panel on a motor vehicle comprising:

a base member having a first end, a second end, a first surface and an opposite facing second surface;

a tool locating member having a front surface, and being connected to said base member at said first end such that the front surface is laterally offset from said first end in a first lateral direction;

a tool holding mechanism connected to said each end of said front surface for holding said tool onto the motor vehicle;

a striker locating arm having a front end, a back end, and a rear surface at the back end facing in a direction generally towards said front surface, wherein the striker locating arm is connected to said base member at said second end such that the striker locating arm extends from said second end in a direction generally away from said front surface and is laterally offset from said second surface in a second lateral direction that is generally opposite said first lateral direction;

a striker lead-in having a U-shaped opening for positioning the striker relative to the latch, wherein the striker lead-in is connected to said striker locating arm at said front end and extends from said front end in said direction generally away from said front surface, said striker lead-in including a magnet embedded near a lower portion of said U-shaped opening for fixedly holding said striker lead-in to the striker; and a cross member connected to said base member and said striker locating arm at said back end such that the cross member extends from said second surface generally in said second lateral direction and is located between said front surface and said back end.

* * * * *